US007334665B2

(12) United States Patent
Smith et al.

(10) Patent No.: US 7,334,665 B2
(45) **Date of Patent: *Feb. 26, 2008**

(54) INTERLOCK WIRING COMMUNICATION SYSTEM FOR ELEVATORS

(75) Inventors: Rory Smith, El Cajon, CA (US); San Aranggi Soemardjan, El Cajon, CA (US); James A. Nickerson, Spring Valley, CA (US); Randolph W. Huff, Hartsdale, NY (US)

(73) Assignee: ThyssenKrupp Elevator Capital Corporation, Troy, MI (US)

( * ) Notice: Subject to any disclaimer, the term of this patent is extended or adjusted under 35 U.S.C. 154(b) by 549 days.

This patent is subject to a terminal disclaimer.

(21) Appl. No.: 10/791,969

(22) Filed: Mar. 2, 2004

(65) Prior Publication Data

US 2005/0194217 A1 Sep. 8, 2005

(51) Int. Cl.
*B66B 1/28* (2006.01)

(52) U.S. Cl. ..... 187/247; 187/391

(58) Field of Classification Search ..... 187/277, 187/247, 290, 296, 297, 413, 391–397
See application file for complete search history.

(56) References Cited

U.S. PATENT DOCUMENTS 4,471,856 A 9/1984 Magee
4,575,720 A 3/1986 Smith
5,892,411 A * 4/1999 Schwan et al. ..... 333/24 R
6,116,381 A 9/2000 Jalbert
6,173,814 B1 * 1/2001 Herkel et al. ..... 187/288
6,412,604 B1 * 7/2002 Schuster ..... 187/290
6,446,761 B1 * 9/2002 Motoyama et al. ..... 187/391
6,467,585 B1 * 10/2002 Gozzo et al. ..... 187/391
6,583,573 B2 6/2003 Bierman
6,629,583 B2 10/2003 Valk et al.
6,630,894 B1 10/2003 Face, Jr. et al.
7,246,689 B2 * 7/2007 Huff et al. ..... 187/395
2002/0157903 A1 10/2002 Nagura et al.
2002/0175651 A1 11/2002 Kaneko et al.

(Continued)

FOREIGN PATENT DOCUMENTS

WO WO-2004/013030 A1 2/2004

OTHER PUBLICATIONS

Paradiso et al., "A compact wireless, self-powered pushbutton controller"; ACM UBICOMP Conference Proceedings, Atlanta GA, Sep. 2001, Springer-Verlag Berlin Heidelberg, 2001, pp. 299-304.

*Primary Examiner*—Jonathan Salata
(74) *Attorney, Agent, or Firm*—Frost Brown Todd LLC

(57) ABSTRACT

The systems and methods of present invention invoke an elevator communication system for providing communication between a plurality of hall fixture devices and at least one elevator system controller. The elevator communication system includes at least one elevator door interlock wiring circuit, which has a first and a second portion. A first transceiver device is coupled to the first portion of the door interlock wiring for transmitting and receiving signals between the at least one elevator system controller and the plurality of hall fixture devices over the interlock wiring. A second transceiver device is coupled to the second portion of the door interlock wiring for transmitting and receiving the signals between the at least one elevator system controller and the plurality of hall fixture devices over the interlock wiring.

42 Claims, 6 Drawing Sheets

U.S. PATENT DOCUMENTS

| | | | | |
|---|---|---|---|---|
| 2003/0006100 | A1 | 1/2003 | Masuda | |
| 2003/0047390 | A1 | 3/2003 | Crenella et al. | |
| 2003/0057030 | A1 | 3/2003 | Yumura et al. | |
| 2003/0089558 | A1* | 5/2003 | Zepke et al. | 187/413 |
| 2004/0026177 | A1* | 2/2004 | Ayano et al. | 187/247 |
| 2006/0108181 | A1* | 5/2006 | Bacellar et al. | 187/247 |

* cited by examiner

INTERLOCK WIRING COMMUNICATION SYSTEM FOR ELEVATORS

FIELD OF INVENTION

The present invention is related to an apparatus and method for providing simplified wiring in elevator systems. More particularly, the present invention is related to using the existing wiring infrastructure within an elevator system for signal communications and control.

BACKGROUND OF INVENTION

Traditionally, signaling devices within elevator systems, such as hall call push buttons, hall lanterns, and positions indicators, which required separate wiring. For example, a twenty floor building would require a signal conductor for each UP and DOWN elevator call button for each floor, where nineteen of the twenty floors would have both UP and DOWN call buttons. Therefore, thirty eight signal conductors would be needed for these nineteen floors. The ground floor and top floor (floor twenty) would respectively have an UP and DOWN call button, which would each require a signal conductor. This brings the total number of signal conductors for the hall call buttons alone to forty. A common conductor (ground conductor) would also be required. If the UP and DOWN arrows were fitted with call acknowledgement lamps, an additional forty conductors would also be required (i.e., for the twenty floor example). Hall lanterns for each floor (for example, up and down arrows located above the hall entrance) would also require two conductors and a ground conductor. Hence, traditional elevator system wiring installations were both more labor intensive and more complex in terms of the higher volume of conductors needed in the wiring schemes. Maintenance and fault finding in these traditional wiring approaches are also more challenging in comparison to more simplified wiring installations.

Elevator systems using microprocessor based equipment provide a reduction in installation wiring time and the number of wires used in the installation. However, these systems use serial communications over data busses, and therefore, still require discrete wiring installation, which is relatively labor intensive.

Some elevator system manufacturers have adapted power line carrier (PLC) technology to provide signal communications between the system controller, car controllers, and various hall fixtures (e.g., hall call button). Using the PLC format for communications, signaling data is transmitted over the building AC power lines. Although PLC reduces the installation costs, it uses the existing electrical power lines within a building as a communications medium. Therefore, equipment using PLC communication are subjected to changes in impedance and power line noise which occur as a result of load changes from different electrical appliances drawing power from various AC sockets within the building. Furthermore, PLC communications is subjected to restrictions and regulations (in US, by the FCC) that are imposed on modulation frequencies, conducted and radiated emissions, and interfacing safety between the power line and communication equipment accessing the power line transmission medium. Finally, transmission of signals over the AC wiring of a building does raise a security risk, where signal tampering and hacking is aided through the use of readily available wall sockets.

Therefore, it is an object of the present invention to provide a simplified wiring system for elevators, wherein the existing elevator wiring infrastructure is used for signal transmission.

It another object of the present invention to use existing elevator wiring for transmitting information over a secure transmission medium.

It is yet another object of the present invention to provide a flexible transmission system capable of using less complex transmission schemes.

It is another object of the present invention to derive electrical power for the existing elevator wiring for providing electrical power to various components of the transmission system.

SUMMARY OF INVENTION

The present invention utilizes the existing interlock wiring of an elevator system for providing bidirectional communication between hall fixture devices and one or more system controllers that are associated with processing signals that are received from the hall fixture devices.

An aspect of the systems and methods of the present invention provides an elevator communication system for providing communication between a plurality of hall fixture devices and at least one elevator system controller, wherein the elevator communication system comprises at least one elevator door interlock wiring circuit. A transceiver device is coupled to the door interlock wiring for transmitting and receiving signals between the at least one elevator system controller and the plurality of hall fixture devices over the at least one interlock wiring circuit.

An aspect of the systems and methods of the present invention provides an elevator communication system for providing communication between a plurality of hall fixture devices and at least one elevator system controller, where the elevator communication system comprises at least one elevator door interlock wiring circuit having a first and a second portion. A first transceiver device is coupled to the first portion of the door interlock wiring for transmitting and receiving signals between the elevator system controller and the plurality of hall fixture devices over the interlock wiring. A second transceiver device is coupled to the second portion of the door interlock wiring for transmitting and receiving the signals between the elevator system controller and the plurality of hall fixture devices over the interlock wiring.

Another aspect of the systems and methods of the invention provides an elevator door interlock wiring circuit comprising a plurality of series connected conductors forming the door interlock circuit of the elevator. A plurality of signaling devices are each located in close proximity to each of the plurality of series connected conductors, wherein each of the plurality of signaling devices couple signals between at least one of a plurality of hall fixtures and each of the plurality of series connected conductors.

Yet another aspect of the systems and methods of the present invention provides a method of signal communications in an elevator system, where the method comprises coupling at least one request signal generated by at least one hall fixture onto at least one elevator door interlock wiring circuit; receiving the at least one request signal from the at least one interlock wiring circuit and generating at least one control signal for responding to a request associated with the at least one request signal; and coupling the at least one control signal from the at least one interlock wiring to the at least one hall fixture from which the at least one request signal originated.

In another aspect of the systems and methods of the present invention, an elevator power supply system provides electrical power to hall fixture devices by accessing an interlock wiring electrical signal flowing in an elevator door interlock wiring circuit, where the power supply system comprises a transformer device located at a proximity to the elevator door interlock wiring circuit for inductively receiving the interlock wiring signal and generating a power supply signal. A power supply unit receives the power supply signal and generates a DC signal, wherein the DC signal is stored in the power supply as stored electrical charge for providing power to electrical circuitry associated with the hall fixture devices.

DETAILED DESCRIPTION

Figure 1:
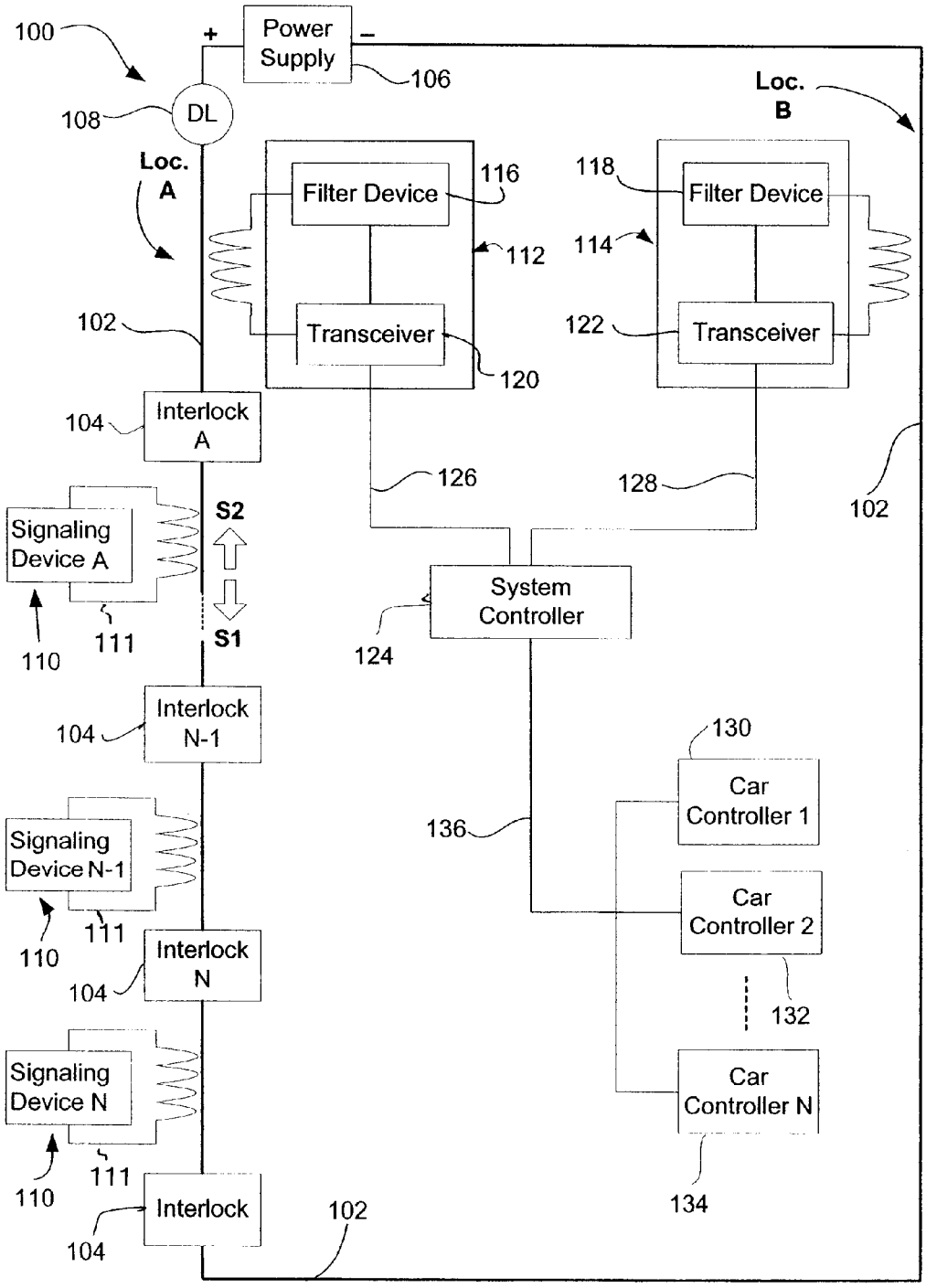
FIG. 1 illustrates a system diagram of a door interlock wiring infrastructure of an elevator system in accordance with the present invention.

FIG. 1 shows an embodiment the a door interlock wiring system 100 according to the present invention. The interlock wiring system comprises a plurality of interlock devices 104 connected in series by interlock wiring 102. The interlock wiring 102 carries 120VAC, provided by a power supply 106 through a relay switch 108. The interlock wiring 102 in combination with interlock devices 104 prevents an elevator cab (not shown) from moving when the doors of that elevator are open. If all the interlock devices 104 are closed (i.e., elevator doors are closed), relay switch 108 is activated and the 120VAC electrical signal from power supply 106 flows through the interlock wiring circuit 102. Therefore, the elevator car is able move. Alternatively, if there is a break (i.e., open circuit) in one of the door interlock devices 104 due to an elevator door being in the open position, the relay switch 108 is deactivated, preventing the 120VAC electrical signal from flowing in the interlock wiring 102. Thus, no current flows in the interlock wiring 102, and the elevator is prevented from moving.

Signaling devices 110 couple rf signals 111 (e.g., hall call signal) onto the interlock wiring 102 by inductive coupling. The rf signal coupled onto the wiring 102 is received by either or both of transceiver modules 112 and 114, where transceiver modules 112 and 114 are comprised of filter devices 116 and 118, and transceivers 120 and 122, respectively. Filters 116 and 118 are high-pass filters that block the 120VAC signal, and pass the coupled rf signals to each respective transceiver 120, 122. Each transceiver 120, 122 accesses the request data signal by demodulating the rf signal. The request data signal may include, among other things, data information associated with the requested signal (e.g., hall call request), and addressing information that corresponds to the location from which the requested signal (e.g., hall call request) originated (e.g., 4th floor landing). Following the demodulation, the request data signal is sent to system controller 124 for processing by either or both of the communication links 126, 128. Based on the processing of the request data signal, system controller 124 sends the appropriate control data to one of the designated car controllers 130, 132, 134, over communications link 136. Communication links 126, 128, and 136, may incorporate optical, rf radio, microwave, cable, or any other suitable communications medium. Also, the communication links 126, 128, 136 may comprise different communication protocols based on the environment and infrastructure of the interlock wiring system 100.

The system controller 124 may also send a control data signal to one of the designated signaling devices 110. For example, once the system controller 124 has processed the request data signal associated with an actuated hall call button (e.g., $4^{th}$ floor landing), the controller may respond by generating a control data signal for illuminating the hall call button's acknowledgment light. The control data signal is sent from the system controller 124 to both transceivers 120 and 122 by communication links 126 and 128. Each transceiver 120, 122 modulates the control data signal onto an rf signal. The transceiver then inductively couples the signal onto interlock wiring 102. The induced rf signal propagates along the interlock wiring 102 and is received by the designated signaling device 110 associated with the hall call button from which the hall call request originated (i.e., $4^{th}$ floor landing). The signaling device 110 receives and demodulates the rf signal in order to access the control data signal. The control data signal may include, among other things, data information associated with the control signal (e.g., acknowledge hall call request), and addressing information that corresponds to the particular signaling device 104 for which the control signal is intended. In the context of the given example, the addressing information may be the address of the signaling device from which the requested signal (e.g., hall call request) originated (e.g., $4^{th}$ floor landing). Once the control data signal is processed by the signaling device 110, the hall call button's acknowledgment light may be activated.

The above description is provided in order to illustrate the signaling, processing, and data communication between the various components of the system. The signaling devices 110 may send a plurality of rf signals to either or both transceivers 120, 122, whereby appropriate networking protocols are established in order ensure that signals and data are reliably transferred and processed within system 100. For example, Carrier Sense Multiple Access with Collision Detection (CSMA/CD) protocols used in Ethernet systems may be incorporated within system 100, so that rf signals generated by the signaling devices 110 are not lost as a result of signal collisions on the interlock wiring 102. These collisions would typically occur if more than one hall call button is simultaneously pressed on different floor landings. CSMA/CD protocols using "back-off" algorithms provide a means for managing signal access to the interlock wiring 102 by sensing signal collisions and managing signal retransmissions. According to the present invention, the system 100 is not limited to utilizing CSMA/CD protocols.

Other networking protocols may also be used based on, but not limited to, the interlock wiring infrastructure, environment, and bandwidth requirements for data transmission.

When one of the signaling devices 110, such as signaling device "A," couples an rf signal onto the interlock wiring 102, the rf signal propagates in two direction S1, S2 toward the transceiver modules 114, 112, respectively. If all the interlock devices 104 are in the closed position (i.e., all elevator doors are shut), the signal will be received by both transceiver modules 112 and 114 at locations Loc. A and Loc. B of the interlock wiring 102. If for example, an interlock device such as interlock "N" is in the open circuit state due to an elevator door on that particular landing being open, the rf signal traveling in the S1 direction cannot flow through the interlock (i.e., interlock "N"). Therefore, this signal cannot be received by transceiver module 114 at Loc. B of the interlock wiring 102. However, since in the elevator system only one interlock can be open at any given time, the interlock devices, such as interlock A, being in a closed circuit position and the rf signal can travel in the S2 direct and be received by transceiver module 112 at Loc. A of interlock wiring 102. For this reason, among others, signal transceiver capabilities are provided at both end section of the interlock wiring 102, namely Loc. A and Loc B. Hence, if one of the interlock devices 104 is in the open circuit position, the rf signal with have a transmission path to either one of the transceiver modules 112, 114.

Figure 2:
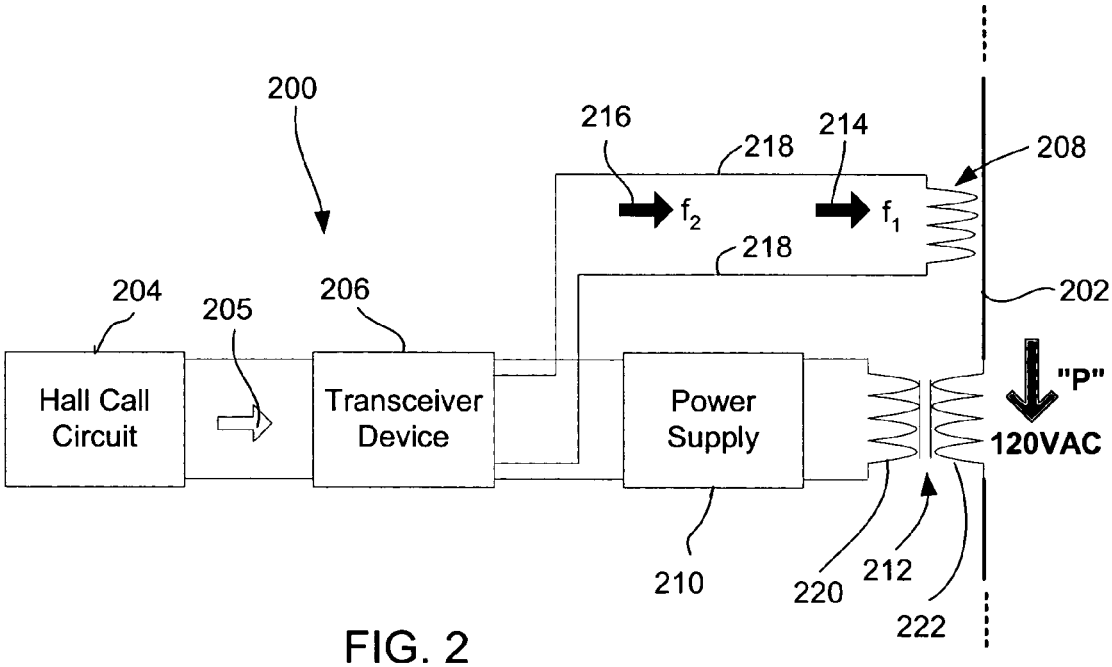
FIG. 2 illustrates a signaling device used to access the interlock wiring of the elevator system in accordance with the present invention.

FIG. 2 illustrates a signaling device 200 used to access the interlock wiring 202 of the elevator system in accordance with an embodiment of the present invention. Signaling device 200 is also illustrated in FIG. 1 as signaling device 110. The signaling device 200 comprises a hall call circuit 204, an interface transceiver device 206, an induction or coupling device 208, a power supply 210, and a power coupling transformer 212.

The hall call circuit 204 generates request data signals that are received by transceiver 206. A request signal may include data associated with the request and addressing information. Other information such as error control coding may also be incorporated into the data format of the request signal. For example, hall call circuit 204 generates a hall call request data signal 205 when the hall call button is actuated. However, circuit 204 may comprise any circuit capable of generating request data and/or providing data information that is intended for processing by the system controller 124 (FIG. 1). Accordingly, transceiver 206 receives request signal 205 from the hall call circuit 204, and generates rf signals 214 and 216 by modulating the request signal 205 onto two separate rf carrier frequencies (i.e., $f_1$ and $f_2$). Rf signals 214 and 216 are sent to induction device 208 by signal conductors 218, where the induction device 208 may be an antenna device placed in close proximity to the interlock wiring 202. The rf signals emitted from the antenna are inductively coupled to the interlock wiring 202 in this way.

Other methods of electromagnetic, magnetic, or electric field coupling of a signal onto the interlock wiring may also be used without departing from the spirit and scope of the present invention. For example, capacitive coupling may also facilitate the signal coupling process. Other means of coupling envisioned may include using other properties of the interlock wiring 202 to transfer signals between the signaling device 200 and, for example, transceivers 112 and 114 (FIG. 1). It may be possible to use the insulation, shielding, or other protective layers, which may form part of the cable or medium used in an interlock wire system. Accordingly, the signaling device will use the appropriate coupling means. For example, optical signaling may be used to couple light into certain plastic materials that may form part of an interlock wire cable or signal carrying medium.

Signaling device 200 also derives power for operating the transceiver 206 and hall call circuit 204 by coupling a portion of the 120VAC signal "P" propagating through the interlock wiring 202. By placing the secondary windings 222 of power coupling transformer 212 in proximity with interlock wiring 202, the 120VAC electrical signal can be inductively coupled onto the secondary windings 222. The signal voltage (120V) in the secondary windings 222 is then stepped down based on primary windings 220. The reduced voltage is received, rectified, and regulated by power supply 210 in order to provide power to transceiver 206 and hall call circuit 204. Power supply 210 also has electrical charge storage capabilities, such as a capacitive charging device for storing charge that is inductively coupled from the interlock wiring 202 using transformer 212. This enables power to the transceiver 206 and hall call circuit 204 to be sustained during periods where the 120VAC signal does not flow in the interlock wiring 202 (i.e., an open elevator door on a particular floor or landing). During periods where the 120VAC signal flows in the door interlock wiring circuit, the capacitive charging device stores charge for continuously providing power to the to the transceiver 206 and hall call circuit 204.

Figure 3:
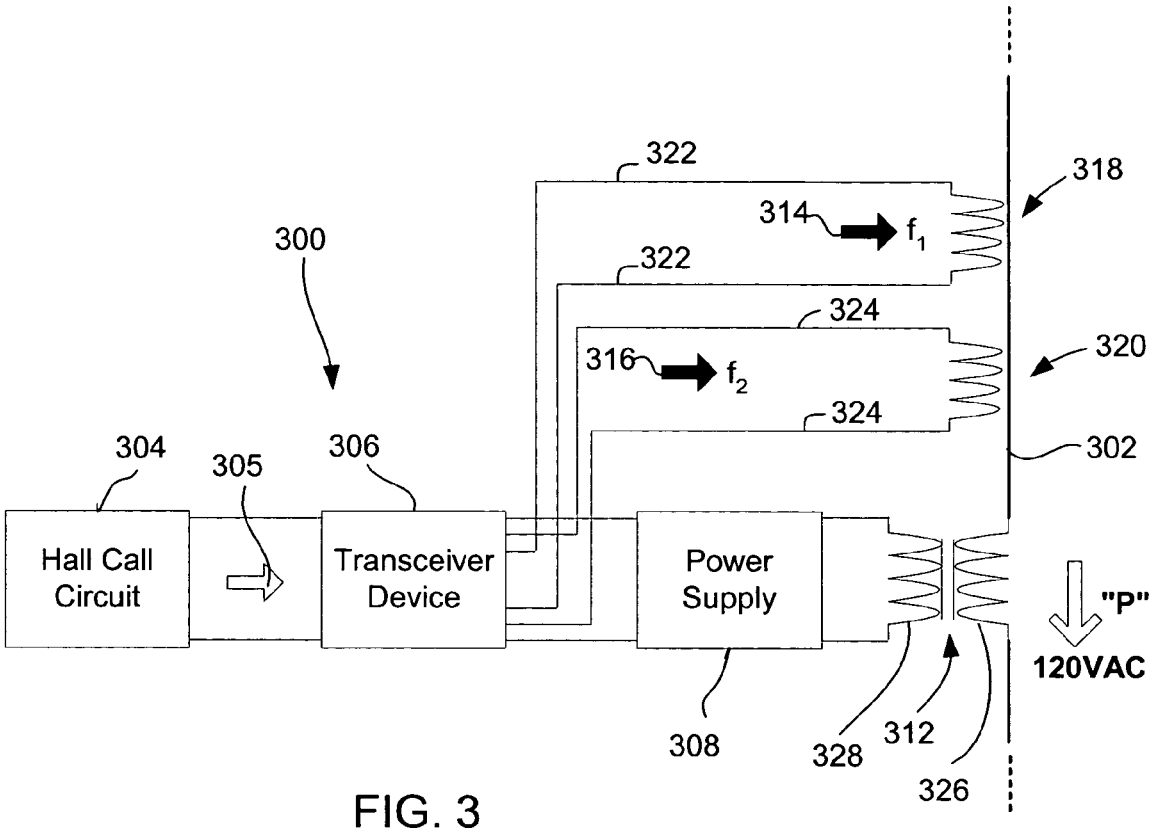
FIG. 3 illustrates a signaling device used to access the interlock wiring of the elevator system according to an alternative embodiment the present invention.

FIG. 3 illustrates an alternative embodiment of a signaling device 300 used to access the interlock wiring of the elevator system according to the present invention. As with the signaling device 200 shown in FIG. 2, signaling device 300 comprises a hall call circuit 304, an interface transceiver device 306, an induction device 308, a power supply 310, and a power coupling transformer 312. The hall call circuit 304 generates request data signals that are received by transceiver 306. A request data signal may include data associated with the request and addressing information. Other information such as error control coding may also be incorporated into the data format of the request signal. Hall call circuit 304 generates a hall call request data signal 305. However, circuit 304 may comprise any circuit capable of generating request data and/or providing data information for processing by the system controller 124 (FIG. 1). Transceiver 306 receives request signal 305 from the hall call circuit 304, and generates rf signals 314 and 316 by modulating the request data signal 305 onto two separate rf carrier frequencies (i.e., $f_1$ and $f_2$). Modulated rf signals 314 and 316 are sent to induction devices 318 and 320, over signal conductors 322 and 324, respectively. The induction devices 318 and 320 may be antenna devices placed in close proximity to the interlock wiring 302. The rf signals emitted from these antennae are, therefore, inductively coupled to interlock wiring 302.

In the embodiment shown in FIG. 3, each rf signal 314, 316 is inductively coupled or induced onto the interlock wiring 302 by means of a designated induction or coupling device 318, 320, whereby rf signal 314 is coupled to the interlock wiring 302 by means of induction device 318, and via conductor 322. Similarly, rf signal 316 is coupled to the interlock wiring 302 by means of induction device 320, and via conductor 324.

By using separate induction devices for coupling rf signals onto the interlock wiring 302, additional redundancy is added between the output of the transceiver 304 and the induction or coupling device (318 or 320) it is in communication with. For example, if the transceiver output driving induction device 318 fails, or conductor 322 has a broken connection, the other transceiver output driving induction device 320 may be used to inductively couple rf frequency 316 ($f_1$) onto the interlock wiring 302. This rf signal may then be used to communicate with both or either transceiver module 112, 114 (FIG. 1).

Signaling device 300 also derives power for operating the transceiver 306 and hall call circuit 304 by coupling a portion of the 120VAC signal "P" propagating through the interlock wiring 302. By placing the secondary windings 326 of power coupling transformer 312 in proximity with interlock wiring 302, the 120VAC electrical signal can be inductively coupled onto the secondary windings 326. The signal voltage (120V) in the secondary windings 326 is then stepped down based on primary windings 328. The reduced voltage is received, rectified, and regulated by power supply 308 in order to provide DC power to transceiver 306 and hall call circuit 304. Similarly, power supply 308 also has electrical charge storage capabilities, such as a capacitive charging device (not shown) for storing charge that is inductively coupled from the interlock wiring 302 using transformer 312. This enables power to the transceiver 306 and hall call circuit 304 to be sustained during periods where the 120VAC signal does not flow in the interlock wiring 302 (i.e., an open elevator door on a particular floor or landing). During periods where the 120VAC signal flows in the door interlock wiring circuit, the capacitive charging device stores charge for continuously providing power to the to the transceiver 206 and hall call circuit 204.

According to the present invention, the signal conductors 214, 322, 324 between the induction device(s) and transceiver, as shown in FIGS. 2 and 3, may be replaced by other suitable means of communication, such as optic fiber, coaxial cable, a radio, or infra-red link.

Figure 4:
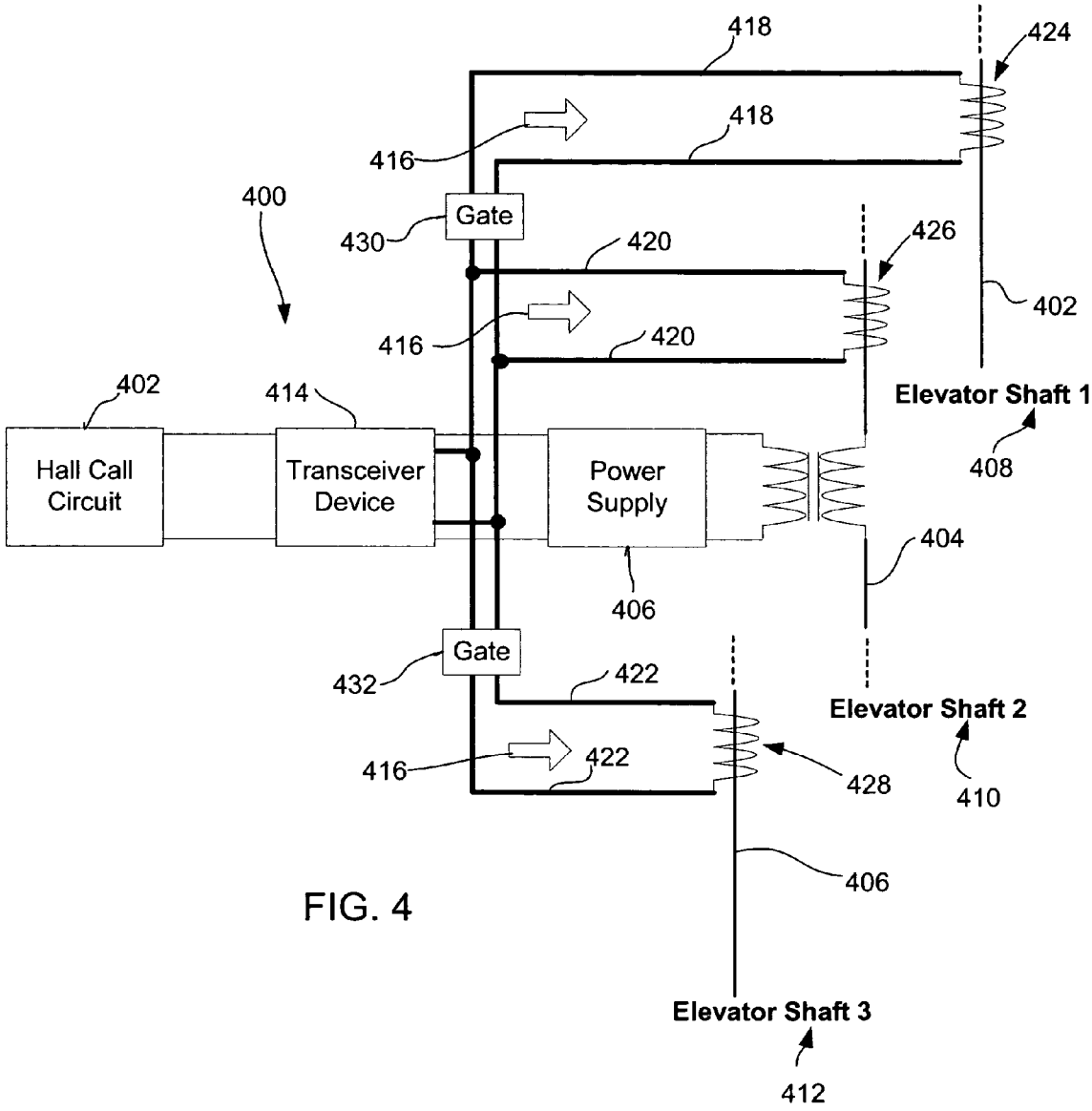
FIG. 4 illustrates the door interlock wiring infrastructure of the elevator system in the present invention, wherein the interlock wiring of several elevator cars are connected.

FIG. 4 illustrates the door interlock wiring infrastructure of the elevator system according to an embodiment the present invention. As shown in FIG. 4, signaling device 400 is coupled to the interlock wiring 402, 404, 406 of several elevator shafts 408, 410, 412 at the landing or floor. This infrastructure (at each floor or landing) provides additional redundancy for transmitting and receiving rf signals between the transceiver modules 112, 114 (FIG. 1), system controller 124 (FIG. 1), and signaling device 400 when a single hall call device is used for making hall call requests for a group of elevators (i.e., two or more) at any given floor or landing. Transceiver device 414 generates rf signals 416 (i.e., at frequency $f_1$ and $f_2$) that are transmitted over conductors 418, 420, and 422, and received by induction or coupling devices 424, 426, and 428, respectively. Optional gate switches 430 and 432 can either be in an open or closed position. If interlock wiring 404 is providing a communication channel for the generated rf signals, gates 430 and 432 may be in an open position, so that the generated rf signals are only received by interlock wiring 404.

If transceiver 414 is only inductively coupled to interlock wiring 404 by means of induction device 426, all hall call requests for the elevator cars in elevator shafts 408, 410, and 412 are communicated over this interlock wiring 404. However, if the elevator in shaft 410 happens to be "out of service," the interlock wiring 404 in this shaft 410 may not be able to maintain a communication channel between signaling device 400, the transceiver modules 112, 114 (FIG. 1), and the system controller 124 (FIG. 1). This is due to the interlock devices (not shown in FIG. 4) of interlock wiring 404 being in an open circuit state, which impedes any signal flow in the interlock wiring 404. Therefore, when interlock wiring 404 cannot be used as a result of an "out of service" elevator, either or both interlock wiring 402 or 406 may be used for establishing an alternative communications path between signaling device 400, the transceiver modules 112, 114 (FIG. 1), and system controller 124 (FIG. 1). Similarly, if either or both of the elevators in shafts 408 and 412 are "out of service," an alternative interlock wiring (e.g., interlock wiring 404) may provide the necessary communication path between the system controller 124 (FIG. 1). Either gate 430 or 432 may be used in order to select the designated interlock wiring as a communication channel. The gates 430, 432 control the flow of rf signals onto interlock wiring 402 and 406, respectively, in order to avoid unnecessarily loading them with rf signal traffic. For example, if interlock wiring 404 is unavailable for use, rather than sending the rf signals along both interlock wiring 402 and 406, only one may be selected. Also, if interlock wiring 404 provides a communication path, there may not be a need for sending the same rf signals over interlock wiring 402 and 406. Therefore, in this case, both gates 430 and 432 would be in the open circuit position in order to avoid generating additional signal communications over wiring 402 and 406.

Figure 5:
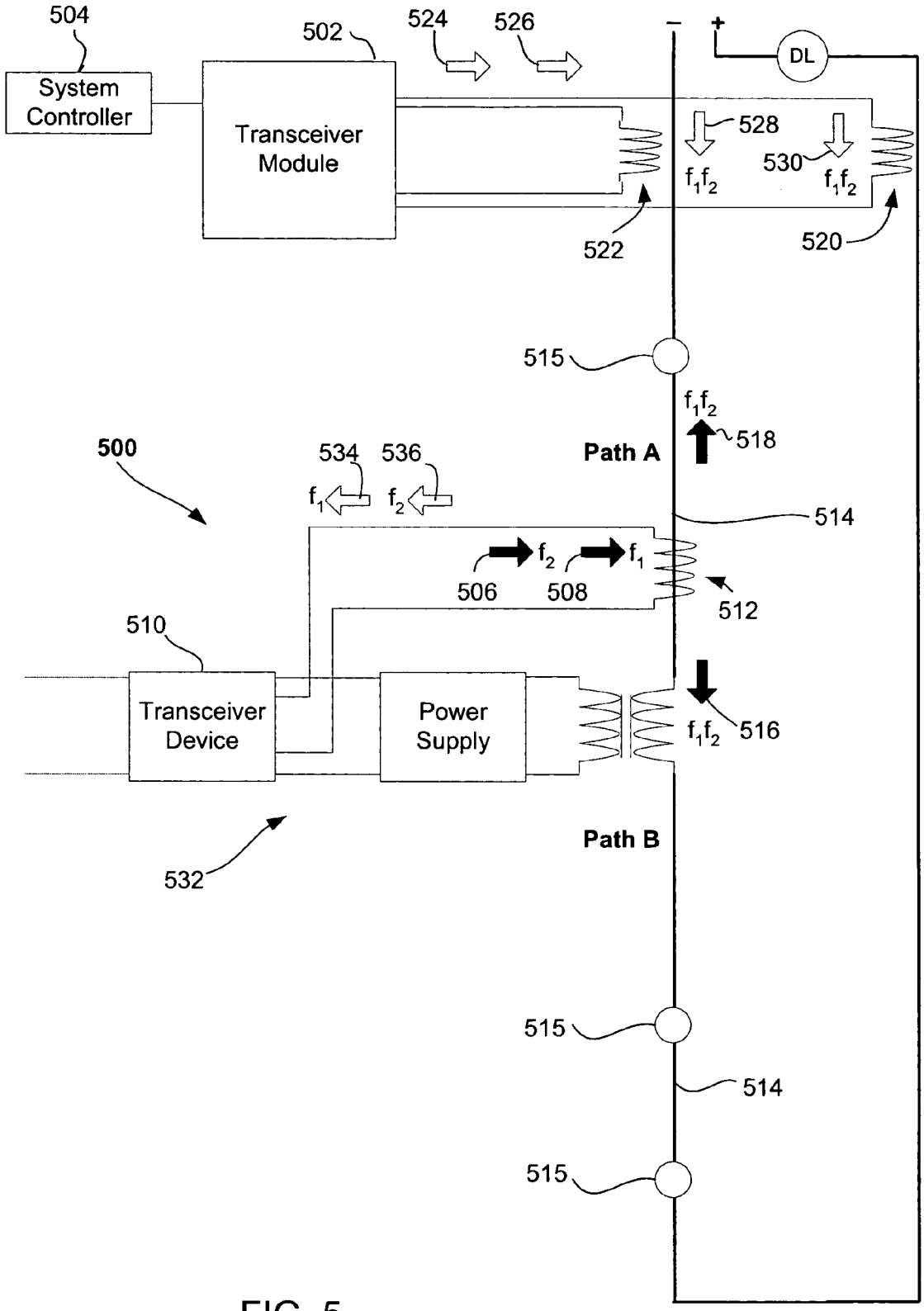
FIG. 5 illustrates a system diagram of a door interlock wiring infrastructure of an elevator system in accordance with an alternative embodiment of the present invention, wherein a single transceiver device communicates with an elevator system controller.

FIG. 5 illustrates a system diagram of the door interlock wiring infrastructure of an elevator system 500 in accordance with an alternative embodiment of an aspect of the present invention, wherein a single transceiver module 502 communicates with a system controller 504. Although not shown in FIG. 5, the system controller 504 is also in communication with one or more car controllers associated with the elevator cars (shown in FIG. 1). The embodiment shown in FIG. 5 is similar to that of FIG. 1, except that in FIG. 5, a single transceiver module 502 is in bidirectional communication with the interlock wiring 514 and system controller 504.

Once a request data signal such as a "hall call request signal" is modulated onto rf signals 506 ($f_1$) and 508 ($f_2$) by means of interface transceiver device 510, both signals 506, 508 are received by induction device 512 and inductively coupled onto interlock wiring 514. If all the elevator doors are closed and their respective door interlock devices 515 are in the closed circuit position, the generated rf signals 506, 508 will propagate in both directions on the interlock wiring circuit. Propagating rf signals 516 ($f_1$, $f_2$) will travel along path B of the interlock wiring 514, while propagating rf signals 518 ($f_1$, $f_2$) will travel along path A. Transceiver module 502 comprises induction devices 520 and 522, where rf signals 516 traveling along path B are received by induction device 520, and rf signals 518 traveling along path A are received by induction device 522. The rf signal from both paths (A and B) are demodulated by transceiver module 502, where the hall call request signal (i.e., identical in each demodulated rf signal) is sent to system controller 504 for processing. Based on the processing, the system controller 504 generates a control data signal, such as, for example, "a hall call acknowledgement signal," which is sent to transceiver module 502.

At the transceiver module 502, the hall call acknowledgement signal is modulated onto rf signals 524 and 526, where both signals 524, 526 are transmitted along paths A and B. Propagating rf signal 528 travels along path A, and propagating rf signal 530 travels along path B. If all interlock devices 515 are in the closed circuit position (all elevator door closed), the designated signaling device that requested "the hall call request," receives the rf signals from both paths A and B. Therefore, in the current example shown in FIG. 5, propagating rf signals 528 and 530 are both received by transceiver 510 from paths A and B, respectively. Rf signals 534 and 536 are received by induction device 512 and coupled to transceiver 510 for demodulation, where the control data signal is extracted from the rf carrier signals ($f_1$, $f_2$). The control data signal (e.g., hall call acknowledgement signal) is received by the hall call request circuit (not shown) and the designated signal function is executed, i.e., turn on hall call button's acknowledgement light.

If any of the interlock devices are in the open circuit position (i.e., an elevator door being open), the propagating rf signals 516, 518, 528, 530 may travel in either one of available paths A or B. As already described, by sending the rf signals in both directions along two paths, even if an interlock device is in the open circuit state, an alternative propagation path may be established between the requesting signaling device (e.g., signaling device 532) and the system controller (e.g., system controller 504).

In accordance with the present invention, a single rf signal ($f_1$) rather than two rf frequencies ($f_1$, $f_2$) may be used for communication between any individual signaling device 532 and the system controller 504. Multiple frequencies may also be used depending on the communication protocol implemented in the interlock wiring communication system. The system according to the present invention is not limited to any particular signaling scheme for accessing and communicating over the interlock wiring, nor is the system restricted to the number of induction devices (e.g., device 512) implemented with each signaling device. Moreover, as illustrated and previously described, each rf signal generated by a transceiver device may be inductively coupled by an individual induction or coupling device device. Alternatively, a single induction device may be used to couple multiple rf frequencies onto the interlock wiring.

The signaling schemes used in the transceivers 118, 120, 206, 306, 414, 502, 510, 606 of the embodiments shown in FIGS. 1-6 may be of any desired format. Therefore, they may not be subjected to federally regulated limits set for carrier frequency allocation and modulation data rates. For example, the transceivers are not limited to using Direct Sequence Spread Spectrum (DSSS) modulation and various digital signal processing techniques that are normally used in order to overcome frequency dependent attenuation which occurs as a result of various load changes that occur in power line carrier (PLC) systems. The use of the elevator's door interlock wiring, at least in part, resolves these issues. Therefore, the transceivers 118, 120, 206, 306, 414, 502, 510, 606 may incorporate modulation schemes such as Amplitude Shift Keying (ASK), Frequency Shift Keying (FSK), Phase Shift Keying (PSK), etc. The modulation bandwidth may also extend according to the signaling needs of the system.

Figure 6:
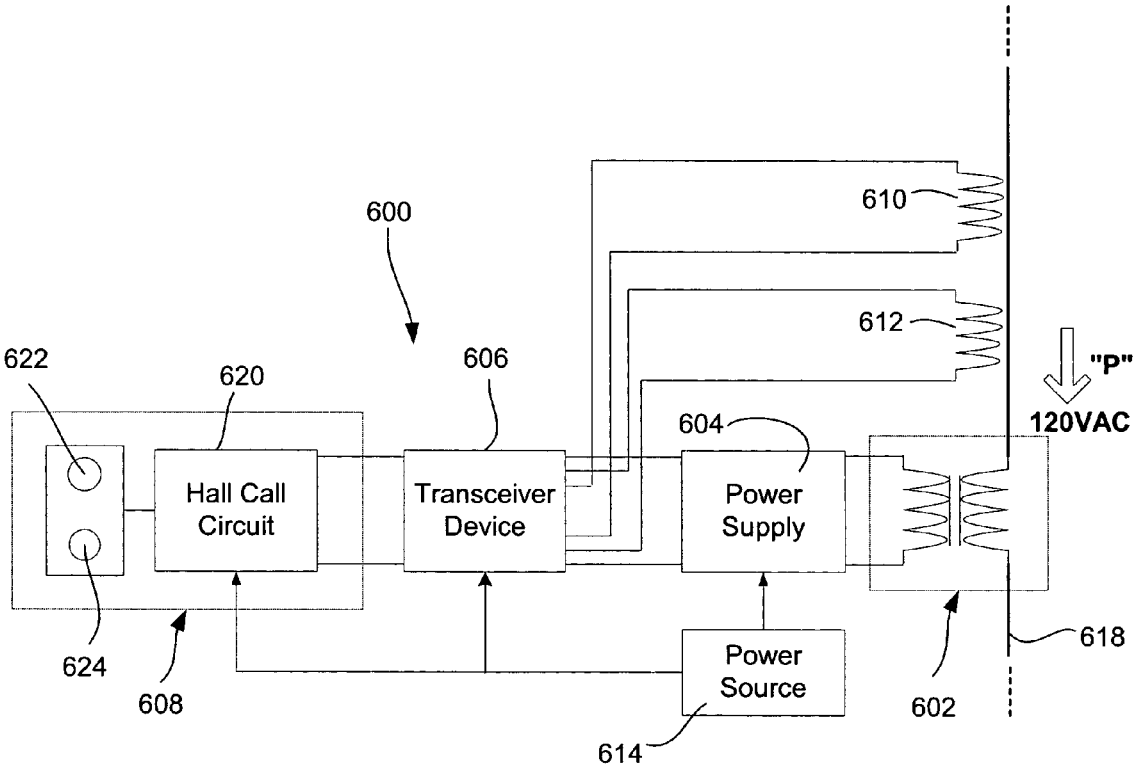
FIG. 6 illustrates a signaling device used to access the interlock wiring of the elevator system, wherein the signaling device includes an alternative power source for providing electrical power to electrical circuitry included in the signaling device according to the present invention.

FIG. 6 illustrates a signaling device 600 according to an embodiment of the present invention, which includes an alternative power source for providing electrical power to electrical circuitry associated with the signaling device 600. As shown in FIG. 6, the signaling device 600 comprises a coupling transformer device 602, power supply 604, transceiver 606, hall fixture device 608, coupling devices 610 and 612, and a power source 614. As previously described, 120VAC signals flowing in the door interlock wiring circuit 618 are inductively coupled from the interlock wiring 618 to power supply 604, where a DC electrical signal is generated and stored for providing power to the transceiver 606 and the hall fixture device 608. The hall fixture device may, among other things, include a hall call circuit 620 comprising a hall call up button 622 and a hall call down button 624, whereby actuating the up and down buttons 622, 624 generates a hall call request signal by hall call circuit 620. The hall fixture device may include any device for providing either bidirectional or unidirectional signal communications between existing devices and fixtures in an elevator hall or landing, and the Electrical power to the hall call circuit, the transceiver device 606, and for the illumination of the buttons 622, 624 is provided by power supply 604, as previously described at length. However, an alternative power source 614 may also be used in addition to, or independently of power supply 604, in order to provide electrical power to various electrical circuitry associated with the signaling device 600. Power source 614 may provide additional electrical charge for storage within power supply 604, as well as the stored electrical charge extracted from the interlock wiring 618 by transformer 602. Power source 614 may also independently provide power to the signaling device 600. In this case, the power source 614 acts as a redundant source of power during instances where a failure is experienced in the power supply 604 and/or transformer 602. In instances were backup power is being used due to a failure, the buttons 622, 624 may use liquid crystal elements that change from silver to black when a button has been actuated. Instead of providing power to illuminate one of the buttons 622, 624, lower electrical power is consumed by providing lower power electrical signals to the liquid crystals, which in turn changes their color.

Power source 614 may comprise a solar power device for generating and storing electrical power from ambient light received by the solar power device. The power source 614 may also comprise a mechanical-to-electrical conversion and storage device that converts the movement from, for example, an elevator door, into electrical power. The generated electrical power is then stored for providing power to the signaling device 600. A piezoelectric device or fly wheel may be used to provide the conversion between mechanical movement and electrical power generation.

Other examples of control data signals are, but not limited to, control signals for activating a hall call acknowledgement lamp located at an elevator landing, control signals for activating a sound gong when the elevator arrives at a floor, control signals for activating an elevator position indicator located at an elevator landing, and control signals for turning off a hall acknowledgement lamp when an elevator arrives at the requested floor. Similarly, there are other request data signals, one of which is a hall call request. However, the data signals mentioned herein are for purposes of illustration and not of limitation, and, therefore, would be know to those of ordinary skill in the art.

In addition to the embodiments of the aspects of the present invention described above, those of skill in the art will be able to arrive at a variety of other arrangements and steps which, if not explicitly described in this document, nevertheless embody the principles of the invention and fall within the scope of the appended claims. For example, the ordering of method steps is not necessarily fixed, but may be capable of being modified without departing from the scope and spirit of the present invention.

What is claimed is:

1. An elevator communication system for providing communication between a plurality of hall fixture devices and at least one elevator system controller, the elevator communication system comprising: (a) at least one elevator door interlock wiring circuit; and (b) a transceiver device coupled to the at least one door interlock wiring circuit for transmitting and receiving signals between the at least one elevator system controller and the plurality of hall fixture devices over the at least one interlock wiring circuit.

2. The system according to claim 1, wherein the plurality of hall fixture devices each further comprise a signaling device for coupling the signals between each of the plurality of hall fixture devices and the transceiver device over the at least one door interlock wiring circuit.

3. The elevator communication system of claim 2, wherein the signaling device comprises: (a) an interface transceiver device for generating and receiving the signals; and (b) at least one coupling device placed in close proximity with the elevator door interlock wiring circuit for coupling the transmitted and received signals between the elevator door interlock wiring circuit and the interface transceiver.

4. The elevator communication system of claim 3, wherein the at least one coupling device is an induction device for inductively coupling the transmitted and received signals between the elevator door interlock wiring circuit and the interface transceiver.

5. The elevator communication system of claim 3, wherein the at least one coupling device is a capacitive device for capacitively coupling the transmitted and received signals between the elevator door interlock wiring circuit and the interface transceiver.

6. The elevator communication system of claim 3, wherein the interface transceiver comprises a transmitter for transmitting request data signals received from one of the plurality of hall fixture devices onto the door interlock wiring circuit.

7. The elevator communication system of claim 6, wherein the transmitted request data signals by the interface transceiver comprise an rf signal modulated with the request data signals.

8. The elevator communication system of claim 3, wherein the interface transceiver includes a receiver for receiving control signals over the interlock wiring circuit from the elevator system controller and transceiver device.

9. The elevator communication system of claim 8, wherein the interface transceiver comprises a demodulation circuit for demodulating the received control signals and sending the demodulated control signals to one of the plurality of hall fixtures.

10. The elevator communication system of claim 9, wherein the demodulated control signals comprise control data signals generated by the elevator system controller.

11. An elevator communication system for providing communication between a plurality of hall fixture devices and at least one elevator system controller, the elevator communication system comprising: (a) at least one elevator door interlock wiring circuit having a first and a second portion; (b) a first transceiver device coupled to the first portion of the door interlock wiring for transmitting and receiving signals between the at least one elevator system controller and the plurality of hall fixture devices over the interlock wiring; and (c) a second transceiver device coupled to the second portion of the door interlock wiring for transmitting and receiving the signals between the at least one elevator system controller and the plurality of hall fixture devices over the interlock wiring.

12. The system according to claim 11, wherein the plurality of hall fixture devices each further comprise a signaling device for coupling the signals between each of the plurality of hall fixture devices and the first and second transceiver device over the door interlock wiring circuit.

13. The elevator communication system of claim 12, wherein the signaling device comprises: (a) an interface transceiver device for generating and receiving the signals; and (b) at least one coupling device placed in close proximity with the elevator door interlock wiring circuit for coupling the generated and received signals between the elevator door interlock wiring circuit and the interface transceiver.

14. The elevator communication system of claim 13, wherein the at least one coupling device is an induction device for inductively coupling the generated and received signals between the elevator door interlock wiring circuit and the interface transceiver.

15. The elevator communication system of claim 13, wherein the at least one coupling device is a capacitive device for capacitively coupling the generated and received signals between the elevator door interlock wiring circuit and the interface transceiver.

16. The elevator communication system of claim 13, wherein the interface transceiver comprises a transmitter for transmitting request data signals received from one of the plurality of hall fixture devices onto the door interlock wiring circuit.

17. The elevator communication system of claim 13, wherein the interface transceiver includes a receiver for receiving the signals transmitted from the first and second transceiver over the door interlock circuit to one of the plurality of hall fixtures.

18. The elevator communication system of claim 16, wherein the transmitted request data signals by the interface transceiver comprises an rf signal modulated with the request data signals.

19. The elevator communication system of claim 17, wherein the received signals transmitted from the first and second transceiver comprises an rf signal modulated with control data signals.

20. The elevator communication system of claim 11, wherein the at least one elevator door interlock wiring circuit comprises at least two elevator interlock wiring circuits, wherein the at least two elevator interlock wiring circuits are connected to each other on each landing.

21. An elevator door interlock wiring circuit comprising: (a) a plurality of series connected conductors forming the door interlock circuit of the elevator; and (b) a plurality of signaling devices each of which are located in close proximity to each of the plurality of series connected conductors, wherein each of the plurality of signaling devices couple signals between at least one of a plurality of hall fixtures and each of the plurality of series connected conductors.

22. The elevator door interlock circuit of claim 21, wherein each of the plurality of signaling devices comprises: (a) a coupling device for coupling the signals onto one of the plurality of series connected conductors, and coupling the signals from one of the plurality of series connected conductors; and (b) an interface transceiver device for transmitting the signals received from one the plurality of hall fixtures to the coupling device, and transmitting the signals received from the coupling device to one of the plurality of hall fixtures.

23. The elevator door interlock circuit of claim 21, wherein the coupling device is an induction device for inductively coupling the signals onto one of the plurality of series connected conductors and inductively coupling the signals from one of the plurality of series connected conductors.

24. The elevator door interlock circuit of claim 21, wherein the coupling device is a capacitive device for capacitively coupling the signals onto one of the plurality of series connected conductors and capacitively coupling the signals from one of the plurality of series connected conductors.

25. The elevator door interlock circuit of claim 21, wherein the signals are control signals sent between an elevator system controller and the plurality of fixture devices.

26. The elevator door interlock circuit of claim 22, wherein each of the plurality of interface devices further comprises a power supply for providing power to the interface transceiver device and one of the plurality of hall fixtures.

27. The elevator door interlock circuit of claim 26, wherein the power supply comprises a capacitive charging device that is charged by coupled power from one of the plurality of series connected conductors, and wherein the coupled power is stored by the capacitive charging device for providing power to the transceiver device and one of the plurality of hall fixtures.

28. The elevator door interlock circuit of claim 26, wherein the power supply further comprises a coupling transformer for inductively coupling power from one of the plurality of series connected conductors to the capacitive charging device.

29. A method of signal communications in an elevator system, the method comprising: (a) coupling at least one request signal generated by at least one hall fixture onto at least one elevator door interlock wiring circuit; (b) receiving the at least one request signal from the at least one interlock wiring circuit and generating at least one control signal for responding to a request associated with the at least one request signal; and (c) coupling the at least one control signal from the at least one interlock wiring to the at least one hall fixture from which the at least one request signal originated.

30. The method according to claim 29, further comprising the step of (d) executing the request associated with the at least one request signal.

31. The method according to claim 29, wherein the at least one request signal coupled onto the at least one door interlock wiring circuit is modulated onto an rf signal.

32. The method according to claim 29, wherein the at least one control signal coupled onto the at least one door interlock wiring circuit is modulated onto an rf signal.

33. The method according to claim 29, wherein the at least one hall fixture is a hall call button.

34. The method according to claim 29, wherein the at least one request signal is a hall call request.

35. An elevator power supply system for providing electrical power to hall fixture devices by accessing an interlock wiring signal flowing in an elevator door interlock wiring circuit, the power supply system comprising: (a) a transformer device located at a proximity to the elevator door interlock wiring circuit for inductively receiving the interlock wiring electrical signal and generating a power supply signal; and (b) a power supply unit for receiving the power supply signal and generating a DC signal, wherein the DC signal is stored in the power supply as stored electrical charge for providing power to electrical circuitry associated with the hall fixture devices.

36. The elevator power supply system according to claim 35, further comprising a power source for providing alternative electrical power to the electrical circuitry.

37. The elevator power supply system according to claim 36, wherein the power source comprises a solar energy conversion device for converting ambient light into electrical charge, and wherein the electrical charge provides electrical power to the electrical circuitry.

38. The elevator power supply system according to claim 36, wherein the power source comprises a mechanical-to-electrical conversion device for converting motion associated with an elevator door into electrical charge, and wherein the electrical charge provides electrical power to the electrical circuitry.

39. The elevator power supply system according to claim 36, wherein the electrical circuitry comprises an elevator hall call circuit.

40. The elevator power supply system according to claim 36, wherein the electrical circuitry comprises a transceiver device.

41. The elevator power supply system according to claim 35, wherein the interlock wiring electrical signal comprises a 120VAC signal.

42. An elevator power supply system for providing electrical power to hall fixture devices by accessing an interlock wiring signal flowing in an elevator door interlock wiring circuit, the power supply system comprising: (a) a transformer device located at a proximity to the elevator door interlock wiring circuit for inductively receiving the interlock wiring electrical signal and generating a power supply signal; and (b) a power supply unit for receiving the power supply signal and generating a DC signal, wherein the DC signal is stored in the power supply as stored electrical charge for providing power to electrical circuitry associated with the hall fixture devices, said power supply system further comprising a power source for providing alternative electrical power to the electrical circuitry, the power source comprising comprises a mechanical-to-electrical conversion device for converting motion associated with an elevator door into electrical charge, and wherein the electrical charge provides electrical power to the electrical circuitry.

* * * * *